US005077994A

United States Patent [19]

Trull et al.

[11] Patent Number: 5,077,994

[45] Date of Patent: Jan. 7, 1992

[54] DOOR LOCK HAVING REMOVABLE OUTSIDE LEVER HANDLE FOR THE PURPOSE OF CHANGING THE KEY CYLINDER

[75] Inventors: Jeffrey G. Trull, Matthews; Sidney J. Lampley, Monroe, both of N.C.

[73] Assignee: Yale Security Inc., Monroe, N.C.

[21] Appl. No.: 680,947

[22] Filed: Apr. 5, 1991

[51] Int. Cl.[5] ..... E05B 13/10

[52] U.S. Cl. ..... 70/224; 70/368; 70/371; 70/DIG. 31; 292/352

[58] Field of Search ..... 70/224, 367-369, 70/215, 216, 371, DIG. 31, DIG. 39; 292/352

[56] References Cited

U.S. PATENT DOCUMENTS 2,027,731 1/1936 Holpfer ..... 70/224
2,062,765 12/1936 Schlage ..... 70/224
2,079,583 5/1937 Brauning ..... 70/224
4,363,578 12/1982 Hesch et al. ..... 267/153 X
4,655,059 4/1987 Best et al. ..... 70/224
4,672,829 6/1987 Gater et al. ..... 70/224 X

*Primary Examiner*—Lloyd A. Gall
*Attorney, Agent, or Firm*—Dallett Hoopes

[57] ABSTRACT

A transverse retaining plate in the lever handle shank fits in a circumferential groove on the inside of the handle body and holds the lever handle on the shank. A key cylinder in the body handle has a bible which fits in a longitudinal slot in the handle. A resilient block is disposed in the slot in a position between the bible and the shank hub to hold the cylinder in position. The block also serves as a spring, biasing the retaining plate toward the groove.

4 Claims, 1 Drawing Sheet

DOOR LOCK HAVING REMOVABLE OUTSIDE LEVER HANDLE FOR THE PURPOSE OF CHANGING THE KEY CYLINDER

BACKGROUND OF THE INVENTION

1. Field of the Invention

This invention relates to a door lock. More specifically, this invention relates to a lockset having an outside lever handle and a lock cylinder in the lever handle and means for permitting removal of the handle from the lockset and withdrawing the cylinder so that the lockset can be easily rekeyed.

2. Description of Related Art including Information Disclosed under §§1.97 to 1.99

The prior art is replete with different kinds of door locks in which the lock cylinder may be removed from the front end of the outside knob. Examples are:

U.S. Pat. No. 2,008,668 which issued July 23, 1935 to R. S. Gold

U.S. Pat. No. 2,027,731 which issued Jan. 14, 1936 to M. Holpfer

U.S. Pat. No. 2,079,583 which issued May 4, 1937 to K. A. Brauning

U.S. Pat. No. 4,672,829 which issued June 16, 1987 to A. C. Gater et al

U.S. Pat. No. 4,765,163 which issued Aug. 23, 1988 to J. G. Trull et al

Another U.S. Pat. No. 3,196,645 which issued July 27, 1965 discloses a door knob with an enlarged neck in which the knob can be removed from the lock and the lock cylinder can be withdrawn out the back of the knob. A retaining plate transversely disposed inside the neck holds the knob on the spindle.

SUMMARY OF THE INVENTION

The invention is a lock having a spindle supported in a hub with a lever handle containing a lock cylinder with a radially extending bible. A transverse retaining plate mounted on the shank extends into a groove in the inside of the handle and holds the handle on the shank. An access hole in the handle permits the technician to push a tool through the hole to depress the plate out of the groove for removal of the handle. The cylinder is removably supported in the body of the lever with its bible in a longitudinal slot in the inside of the body. A resilient block is disposed in the slot in a position between the bible and the hub to hold the cylinder in proper longitudinal position. The resilient block is also near the end of the retaining plate more remote from the groove. Thus the resilient block serves the double function of positioning the cylinder and biasing the retaining plate toward the groove. The tail of the cylinder extends through an irregular opening in the retaining plate which opening has margins which prevent movement of the plate unless the cylinder plug is turned. This can only be done if the key is in the lock.

BRIEF DESCRIPTION OF THE DRAWINGS

Further objects and features of the invention will be understood from the following specification and the drawings, all of which disclose a non-limiting form of the invention. In the drawings.

DESCRIPTION OF THE PREFERRED EMBODIMENT

Figures 1, 2, 3:
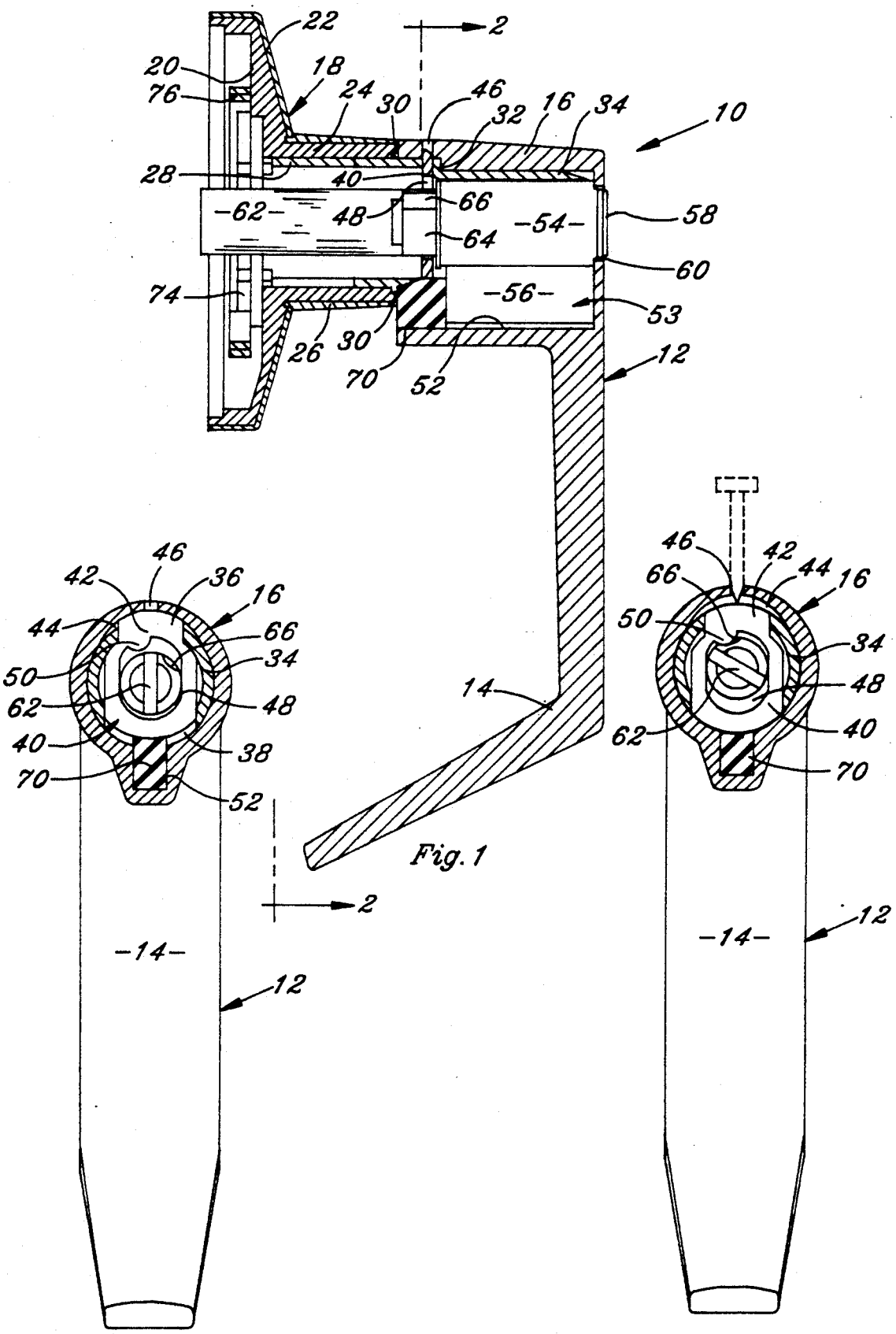
FIG. 1 is a center line sectional view of a handle and rose assembly embodying the invention.
FIG. 2 is a sectional view taken on the line 2—2 of FIG. 1 and showing the handle in retaining condition.
FIG. 3 is a sectional view similar to FIG. 2 but showing the retaining plate depressed preparatory to removing the handle.

A handle/rose assembly for a cylindrical lockset embodying the invention is generally designated 10 in FIG. 1. It comprises a handle 12 having a lever 14 and a tubular body portion 16. The rose assembly 18 comprises the rose 20, the rose scalp 22, the rose boss 24 and the boss liner 26.

Rotatable within the boss 24 is the spindle shank 28 which may be keyed to the lock spindle in a manner well known in the art. The tubular spindle shank 28 is formed with an outward annular shoulder 30 which rides in an annular recess in the end of the boss or hub. The shank is reduced in diameter to form a shoulder 32 and presents a slotted cylinder-encompassing section 34. The body of the handle has an annular recess to receive the shoulder 32.

The spindle shank 28 is formed with diametrically opposed openings 36 and 38 inward from the shoulder 32. A retaining plate 40 is reciprocally disposed in the openings 36 and 38 transversely of the shank. At its upper end (FIG. 2) the plate 40 is formed with a narrowed tongue 42 which fits in the circumferential groove 44 in the handle body 16. A tool hole 46 is formed in the handle body in alignment with the tongue 42.

As shown in FIG. 2, the retaining plate 40 is apertured as at 48 and is formed with a downward lobe 50 in the aperture.

The inside of the handle body (FIG. 1) is formed with a longitudinal slot 52 similar to a keyway. A key cylinder 53 fits into the handle body 16 and comprises a case 54 with a radially extending bible or chimney 56 containing the tumblers. Its keyreceiving face 58 is accessible through an opening 60 in the outer end of the handle body. As is conventional, a lock tailpiece 62 extends inwardly of the lock from the end of the plug 64 the plug being disposed rotatably in the cylinder case 54. The plug 64 is formed with a longitudinal groove 66 in its periphery.

Disposed in the slot 52 in a position between the bible 56 on one side and the annular shoulder 30 on the shank 28 or the end of the boss 24 on the other side is the resilient block 70. The purpose of the block is two-fold. First, it serves to locate the bible 56 and to stabilize the position of the case 54 within the tubular shank section 34. It also serves as a return spring for the retaining plate 42, normally urging the plate upward (FIG. 1) to keep the tongue of the plate in the groove 44.

As is customary, the inward end of the shank 28, aside from mating with the lock spindle, is anchored to a plate 74 which engages a double horseshoe-shaped spring 76, the ends of which are embraced by pins extending inward from the rose 20 and not shown. This arrangement is as described in U.S. Pat. No. 4,920,773 which issued May 1, 1990 to my assignee.

In operation, the handle/rose assembly as described herein is installed on a cylinder lockset. When it is desired to rekey the lock, the key fitting the cylinder 54 is inserted into the face 58 and the key and plug 64 are turned to an angle in which the groove 66 on the plug 64 is disposed immediately beneath the lobe on the retaining plate 42.

It is now possible to insert a tool such as a pin shown in phantom in FIG. 3 into the tool hole. The tip of the tool engages the end of the retainer plate 42. This end may be angled off as shown for better lead-in during the assembly process. The tool is then pressed downward, the far end of the retaining plate engaging the block 70. The block, being resilient, yields and the plate is pressed down as shown in FIG. 3 so that the lobe 50 fits into the groove 66 (FIG. 3). In this position the retaining plate 42 is no longer within the groove 44 and the handle 12 may be removed axially from the shank.

With the handle thus removed it is an easy matter for the technician to move the block 70 from the slot 52 and grab the cylinder by the tailpiece 62 to remove the cylinder 54 out from the body of the handle.

A new cylinder operable by a new key may be selected and may be inserted into the opening in the hollow handle. The bible 56 of the new cylinder is inserted in the slot 52 and the block 70 is reinstalled in its position also in the slot. The tailpiece 62 is then inserted into the tubular section 34 of the shank and the entire handle is moved axially of the shank onto the section 34 as shown. When the inner surface of the handle body engages the retaining plate 42, the aforementioned beveled surface causes the downward camming of the retaining plate as shown in FIG. 1 and the handle is pressed inward of the lock until the retaining plate, driven by the resilience of block 70 which it engages, snaps outward into the groove 44 (FIG. 2). In this position of the handle the tailpiece 62 is positioned in its home within the conventional irregular opening of its closure plate (not shown).

It will be clear to those skilled in the art that the present invention makes possible an easy replacement of a key cylinder in a lever-type lock. The present arrangement owes much of its convenience to the double purpose served by the resilient block 70, namely the location of the cylinder and the spring bias for the retainer plate, all as described above.

While the invention has been shown in only one embodiment, it is not so limited but is of a scope defined by the following claim language and may be broadened by a extension of the right to exclude others from making or using the invention as is appropriate under the doctrine of equivalents.

What is claimed is:

1. In a door lock a hub, a spindle shank journaled in the hub, a lever handle having a tubular body surrounding and in nonrotatable relationship with the spindle shank, an outer face portion of the handle having an opening in alignment with the axis of the spindle shank and a key-operated mechanism disposed centrally in the tubular body with its key-receiving end disposed in the opening, the key-operated mechanism comprising a casing having a tumbler-containing bible extending radially out from the casing, the bible being received in a longitudinal slot in the body, a resilient spacer block disposed in the slot in a position between the bible and the hub, the casing containing a key plug having an inwardly extending flat tailpiece, a handle retaining plate disposed transversely in the shank for reciprocation in a radial direction, a latch groove disposed circumferentially in the inside of the tubular body and normally receiving one end of the retaining plate, the other end of the retaining plate being proximate and in line with the resilient spacer block, the body being formed with a radial operating hole intercepting the circumferential groove whereby a tool may be inserted into the hole to move the retaining plate out of the latch groove against the resilience of the spacer block to permit the handle to be removed from the shank for access to the key-operating mechanism.

2. A door lock as claimed in claim 1 wherein the retaining plate has a central opening to permit passage of the inner end of the plug and the flat tailpiece, the opening having a radially inward abutment surface which engages a surface of the flat tailpiece and blocks movement of the retaining plate when the key for the key-operating mechanism is not in the mechanism, but does not engage the tailpiece when the key is in and partly turned.

3. A door lock as claimed in claim 2 wherein the periphery of the inner end of the plug has a longitudinal groove which when it is aligned with the inward abutment surface permits movement of the retaining plate in a direction out of the latch groove.

4. A door lock as claimed in claim 1 wherein the spacer block is a generally rectangular rubber solid having a beveled corner to serve as a lead-in to move the retaining plate into the circumferential groove as the lever handle is installed onto the shank.

* * * * *